US005829579A

United States Patent [19]

Tsai

[11] Patent Number: 5,829,579

[45] Date of Patent: Nov. 3, 1998

[54] KEY SWITCH ASSEMBLY FOR A COMPUTER KEYBOARD

[76] Inventor: Huo-Lu Tsai, No. 126-1, Shui-Nan Rd., Taichung City, Taiwan

[21] Appl. No.: 909,324

[22] Filed: Aug. 11, 1997

[51] Int. Cl.[6] ..... H01H 13/70

[52] U.S. Cl. ..... 200/344; 200/5 A

[58] Field of Search ..... 200/5 A, 5.2, 5.7, 200/341, 344, 345; 400/490, 491, 491.1, 491.2, 495, 495.1

[56] References Cited

U.S. PATENT DOCUMENTS

| | | | |
|---|---|---|---|
| 5,463,195 | 10/1995 | Watanabe et al. | 200/5 A |
| 5,504,283 | 4/1996 | Kako et al. | 200/5 A |
| 5,512,719 | 4/1996 | Okada et al. | 200/344 |
| 5,630,501 | 5/1997 | Tsay | 200/344 |
| 5,695,047 | 12/1997 | Tanahashi | 200/344 |

*Primary Examiner*—Michael A. Friedhofer
*Attorney, Agent, or Firm*—Morgan & Finnegan LLP

[57] ABSTRACT

A key switch assembly includes a base board, a membrane circuit provided on the base board, an upright biasing member supported on the membrane circuit, a base plate, a scissors-type key cap support including first and second support levers, and a key cap. The first support lever is formed with an aligned pair of cylindrical outward pins. The second support lever includes parallel rods that are formed with an aligned pair of pin bores with downwardly opening entrances to permit extension of the outward pins fittingly and rotatably therein via the entrances so as to couple rotatably the first and second support levers at intermediate portions of the same. The second support lever is further formed with an engaging tab on the inner edge of one of the parallel rods. The first support lever is further formed with an engaging notch on one of the outer edges of the first support lever for receiving the engaging tab therein. The engaging notch has a predetermined width sufficient to limit pivoting movement of the engaging tab therein between a first position, where the key cap is in a non-depressed state, and a second position, where the key cap is in a fully depressed state.

13 Claims, 7 Drawing Sheets

KEY SWITCH ASSEMBLY FOR A COMPUTER KEYBOARD

BACKGROUND OF THE INVENTION

1. Field of the Invention

The present invention relates to a key switch assembly for a computer keyboard, more particularly to a key switch assembly which can be easily assembled in an automated manner and which has a more stable structure as compared with the conventional ones.

2. Description of the Related Art

Referring to FIGS. 1 and 2, a conventional key switch assembly for a computer keyboard is shown to include a base plate 1, a key cap 2, and a scissors-type key cap support 5 which comprises first and second support levers 3, 4, and which is connected between the base plate 1 and the key cap 2. The base plate 1 is formed with an opening 1*f* to permit extension of a biasing member (not shown) therethrough for biasing the key cap 2 upwardly, a pair of aligned first slot retainers 1*a* on one side of the opening 1*f*, a pair of stop plates 1*b* formed respectively at the first slot retainers 1*a*, and a pair of first pivot retainers 1*d* at the other side of the opening 1*f*. The key cap 2 has a bottom side formed with a pair of second slot retainers 2*a* and a pair of second pivot retainers 2*c* opposite to the slot retainers 2*a*. The first support lever 3 is formed as a generally U-shaped frame and has an upper portion formed with a transverse first pivot shaft 3*b* which is retained pivotally in the second pivot retainers 2*c*, a lower portion formed with a pair of outwardly projecting first slide shafts 3*a* which are retained slidably and respectively in the first slot retainers 1*a* and which are limited by the stop plates 1*b* of the base plate 1, and an intermediate portion with an inner edge formed with a pair of opposed recesses 3*c* which open inwardly and upwardly. The first support lever 3 further has a triangular tab 3*d* which projects inwardly from the first pivot shaft 3*b*. The second support lever 4 has an upper portion formed with a transverse second slide shaft 4*b* which is retained slidably in the second slot retainers 2*a* of the key cap 2, a lower portion formed with a pair of outwardly projecting second pivot shafts 4*a* which are retained pivotally and respectively in the first pivot retainers 1*d* of the base plate 1, and an intermediate portion formed with an opposite pair of outward projections 4*c* which extend respectively into the opposed recesses 3*c* of the first support lever 3 for coupling pivotally the first and second support levers 3, 4. The second support lever 4 further has an indented portion 4*d* for receiving the triangular tab 3*d* of the first support lever 3.

Since the first and second support levers 3 and 4 are coupled to one another via the engagements between the outward projections 4*c* and the recesses 3*c* and between the tab 3*d* and the indented portion 4*d*, the first and second support levers 3, 4 are not firmly coupled to one another and tend to disengage from one another when the first and second support levers 3, 4 move pivotally relative to one another during operation of the key cap 2.

SUMMARY OF THE INVENTION

The main object of the present invention is to provide a key switch assembly which has a relatively firm and stable structure and which can be easily assembled in an automated manner with the use of a machine.

Accordingly, the key switch assembly of the present invention includes a base board, a membrane circuit provided on the base board, an upright biasing member supported on the membrane circuit, a base plate, a scissors-type key cap support and a key cap. The membrane circuit has an electrical contact. The base plate is disposed on the membrane circuit and is formed with an opening to permit extension of the biasing member therethrough. The opening has opposite first and second sides. The base plate is further formed with a first slot retainer unit adjacent to the first side of the opening, and a first pivot retainer unit adjacent to the second side of the opening. The key cap support includes first and second support levers with upper and lower portions and intermediate portions that are coupled rotatably about a pivot axis. The lower portion of the first support lever is retained pivotally in the first pivot retainer unit of the base plate. The lower portion of the second support lever is retained slidably in the first slot retainer unit of the base plate. The key cap has a bottom side formed with a second slot retainer unit for retaining slidably the upper portion of the first support lever, and a second pivot retainer unit for retaining pivotally the upper portion of the second support lever. The key cap is biased upwardly by the biasing member and is depressible to compress the biasing member and enable the membrane circuit to produce an electrical signal. The first support lever has a generally U-shaped frame section with upper and lower sides and opposite outer edges. The intermediate portion of the first support lever is formed with an aligned pair of cylindrical outward pins disposed respectively on the outer edges of the first support lever. The second support lever is formed as a generally U-shaped frame which includes parallel rods that flank the outer edges of the first support lever, and a transverse rod that interconnects the parallel rods at the upper portion of the second support lever. Each of the parallel rods has upper and lower sides and an inner edge. The intermediate portion of the second support lever is formed with an aligned pair of pin bores disposed respectively on the inner edges of the parallel rods. Each of the pin bores is formed with an entrance that opens to the lower side of the respective one of the parallel rods. The outward pins on the first support lever extend fittingly and rotatably into a respective one of the pin bores via the entrance so as to couple rotatably the intermediate portions of the first and second support levers. The intermediate portion of the second support lever is further formed with an engaging tab which is disposed on the inner edge of one of the parallel rods adjacent to the pin bore and which extends between the upper and lower sides of said one of the parallel rods. The intermediate portion of the first support lever is further formed with an engaging notch which is disposed on one of the outer edges of the first support lever adjacent to the outward pin and which extends from the upper side to the lower side of the first support lever. The engaging notch receives the engaging tab therein and has a predetermined width sufficient to limit pivoting movement of the engaging tab therein between a first position, where the key cap is in a non-depressed state, and a second position, where the key cap is in a fully depressed state.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
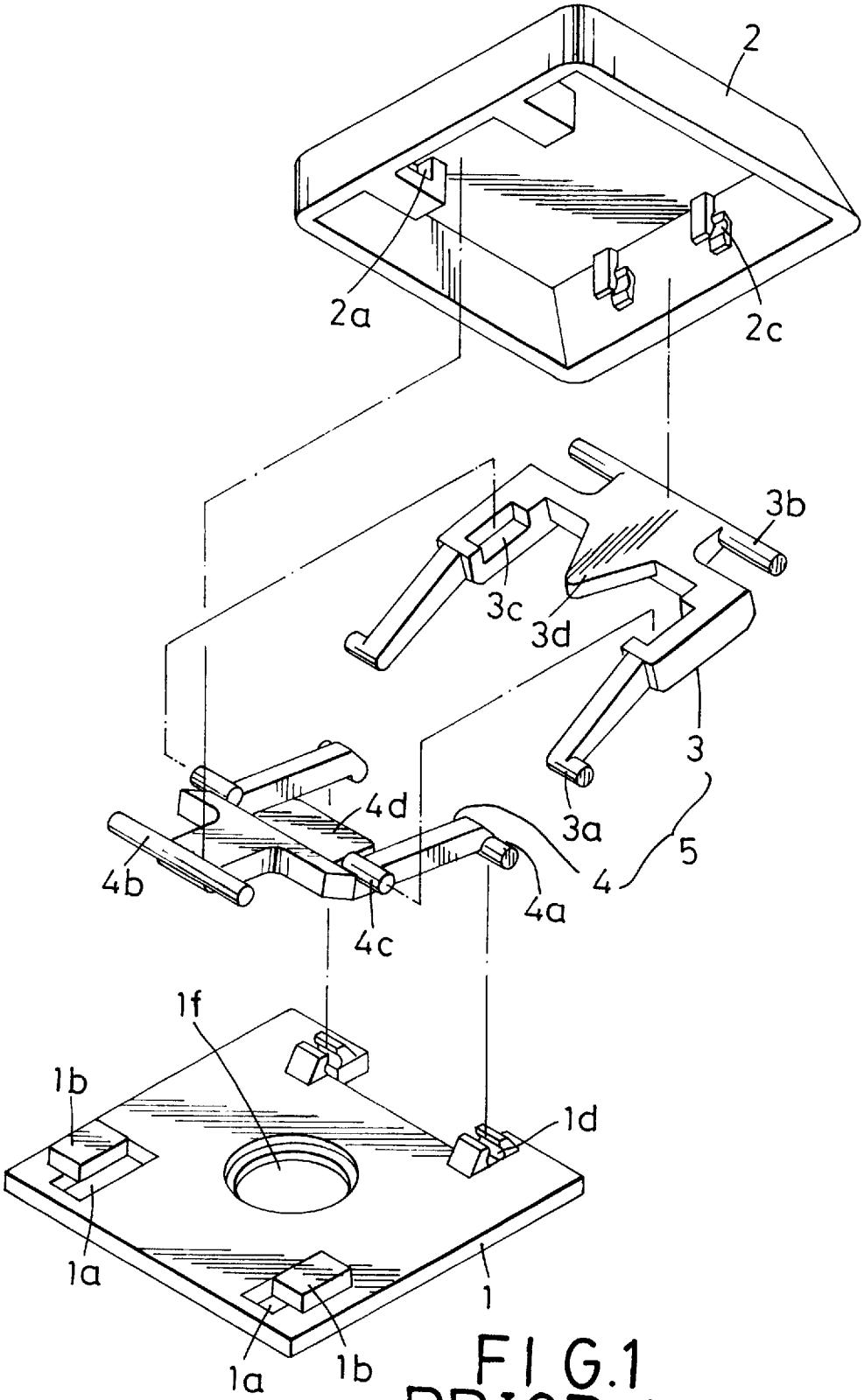
FIG.1 PRIOR ART
FIG. 1 is an exploded perspective view of a conventional key switch.
Figure 2:
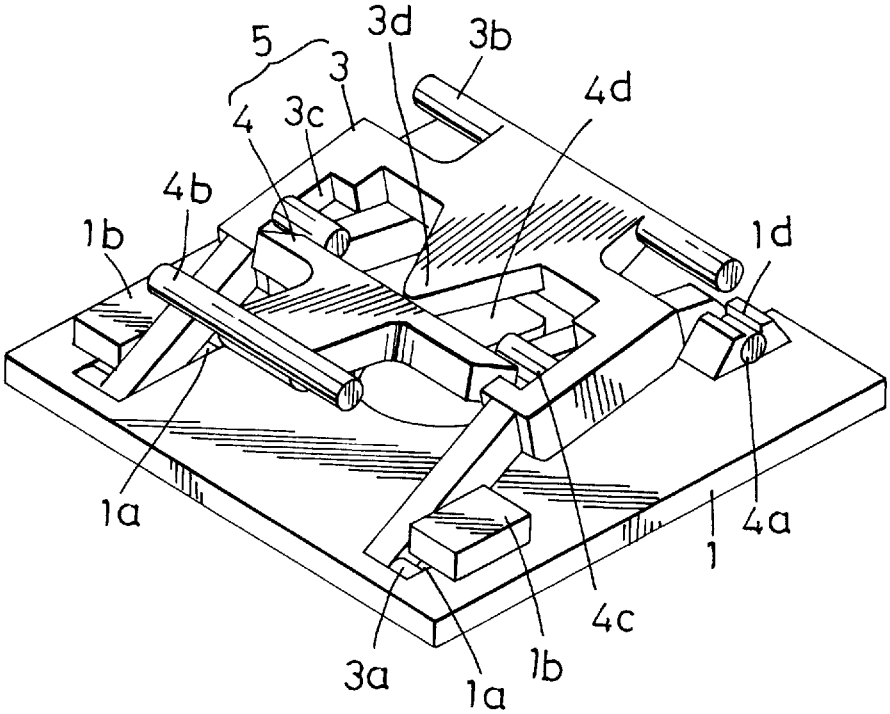
FIG.2 PRIOR ART
FIG. 2 is a perspective view of the conventional key switch of FIG. 1.
Figure 3:
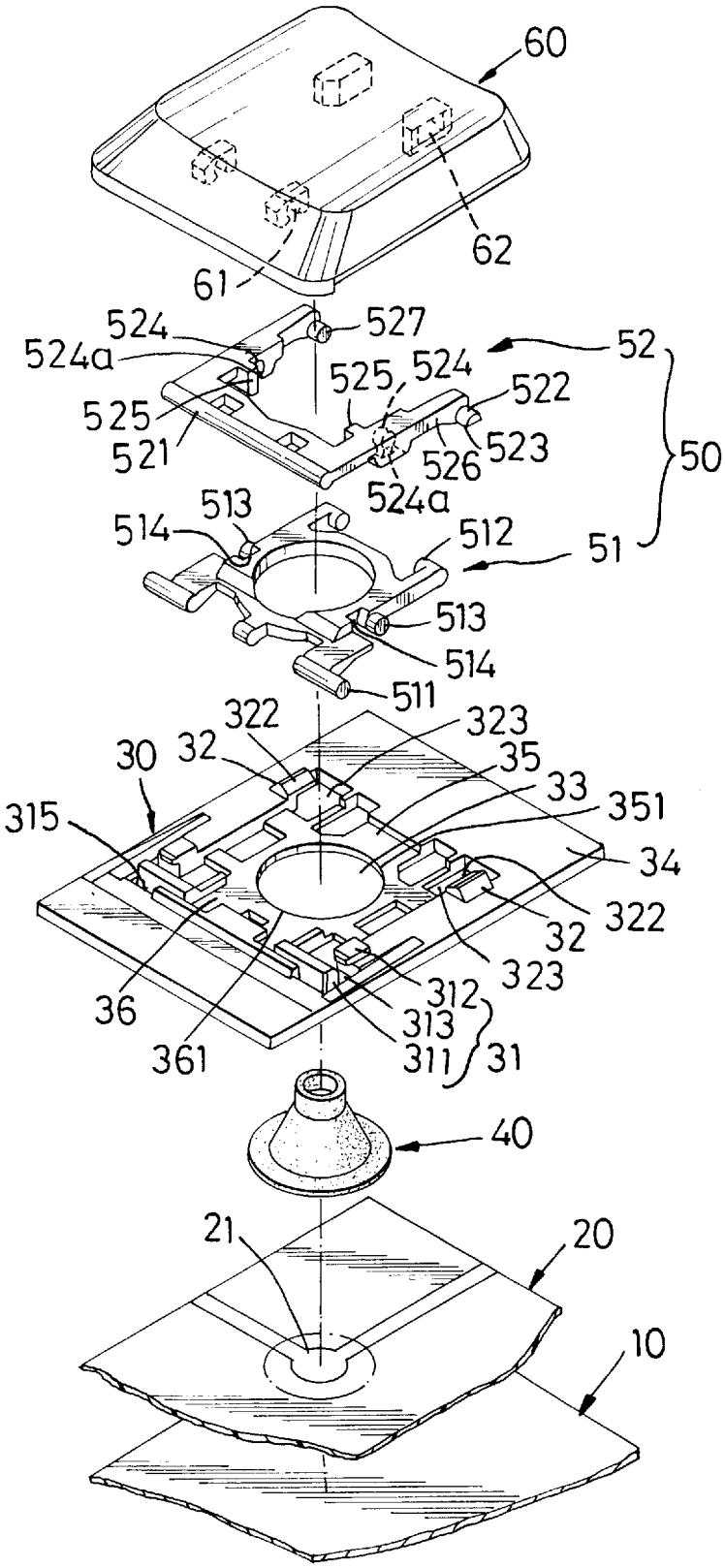
FIG. 3 is an exploded perspective view of a key switch assembly according to a preferred embodiment of the present invention.

Referring to FIG. 3, the key switch assembly of the preferred embodiment of the present invention is shown to include a base board 10, a membrane circuit 20, an upright biasing member 40, a base plate 30, a scissors-type key cap support 50, and a key cap 60.

The membrane circuit 20 is provided on the base board 10 and has an electrical contact 21.

The biasing member 40, preferably a rubber cone, is supported on the membrane circuit 20.

The base plate 30 is disposed on the membrane circuit 20 and is formed with an opening 33 to permit extension of the biasing member 40 therethrough. The base plate 30 has a hollow rectangular key confining frame portion 34, a first hole defining portion 35 which extends inwardly from the frame portion 34 and which has a terminating edge 351, and a second hole defining portion 36 which extends inwardly from the frame portion 34 and which has a terminating edge 361. The terminating edges 351, 361 of the first and second hole defining portions 35, 36 are on opposite first and second sides of the opening 33.

As shown, the first hole defining portion 35 has a top surface that is indented with respect to a top surface of the frame portion 34. The base plate 30 further has a pair of opposite flange units 32 which extend inwardly from the frame portion 34 toward a respective one of two opposite longitudinal edges of the first hole defining portion 35 so as to form two L-shaped slots 323 within the frame portion 34 at the two opposite longitudinal edges of the first hole defining portion 35. The L-shaped slots 323 constitute a first slot retainer unit. The flange units 32 have bottom surfaces which cooperate with the membrane circuit 20 to form slide recesses 324 therebetween (see FIG. 5). Each of the flange units 32 has an inclined top surface 322 which inclines downwardly in a direction toward the L-shaped slots 323.

Figure 5:
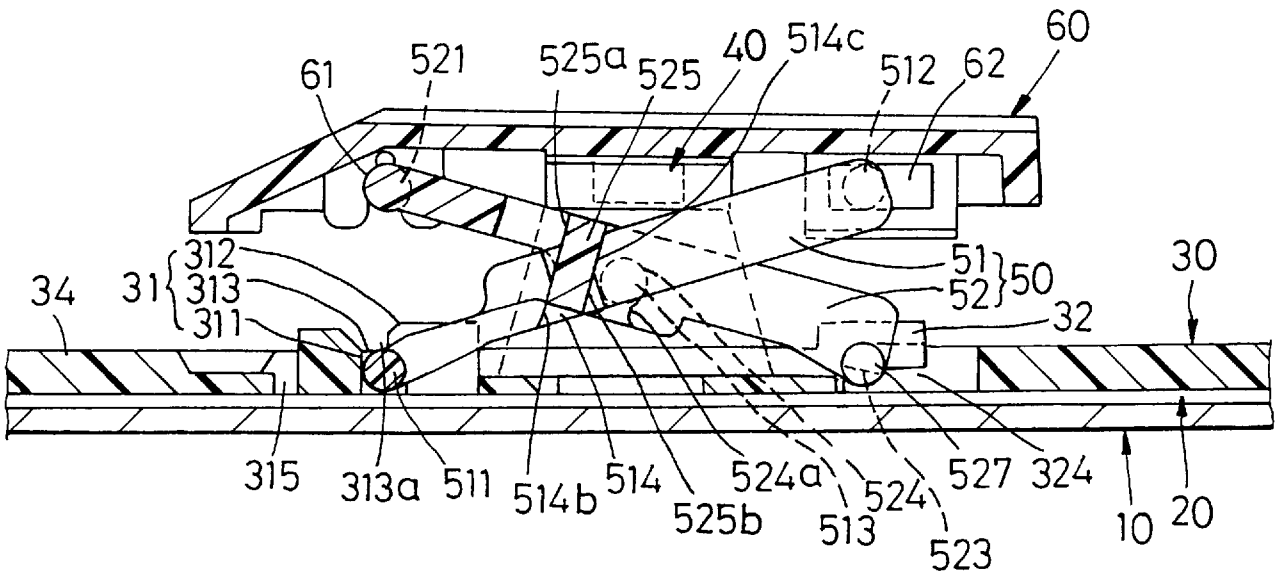
FIG. 5 is a vertical sectional view of the key switch assembly of the preferred embodiment when a key cap thereof is in a non-depressed state.

The second hole defining portion 36 is formed with opposite cantilevers 311 which extend away from a respective one of two opposite longitudinal edges thereof, and opposite barb projections 312 formed on the opposite longitudinal edges of the second hole defining portion 36. The barb projections 312 are aligned respectively and spacedly with the cantilevers 311 so as to define first pivot retainers 313 between aligned ones of the cantilevers 311 and the barb projections 312. The barb projections 312 and the cantilevers 311 constitute a first pivot retainer unit 31. The aligned ones of the cantilevers 311 and the barb projections 312 have top edges that form a converging entrance 313*a* (see FIG. 5) therebetween. As best shown in FIG. 5, each of the cantilevers 311 forms a clearance 315 with the frame portion 34 to enhance resiliency of the cantilevers 311.

The key cap 60 has a bottom side formed with an aligned pair of second slot retainers 62 which constitute a second slot retainer unit, and an aligned pair of second pivot retainers 61 which are opposite to the second slot retainers 62 and which constitute a second pivot retainer unit. The key cap 60 is biased upwardly by the biasing member 40 that extends through the opening 33 of the base plate 30, and is depressible to compress the biasing member 40 and enable the biasing member 40 to contact the electrical contact 21, thereby enabling the membrane circuit 20 to produce an electrical signal.

Figure 4:
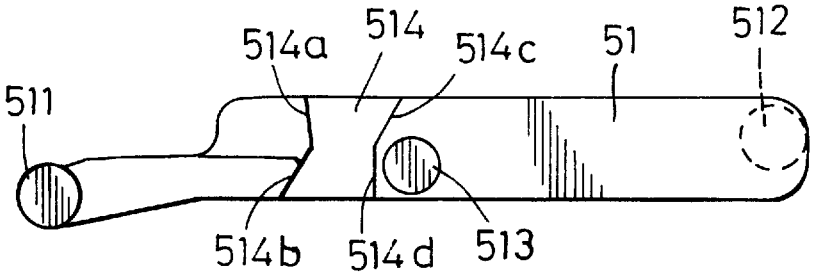
FIG. 4 is a side view of a first support lever of a key cap support of the key switch assembly of the preferred embodiment.

The scissors-type key cap support 50 includes a first support lever 51 and a second support lever 52. The first support lever 51 is formed as a generally rectangular frame with upper and lower sides and opposite outer edges. The first support lever 51 has an upper portion (see FIG. 5) formed with an opposite pair of inward slide projections 512 which extend into the second slot retainers 62 of the key cap 60 and which are retained slidably therein. The first support lever 51 further has a lower portion formed with a pair of opposite outward pivot shafts 511 forced into the first pivot retainers 313 formed between aligned ones of the cantilevers 311 and the barb projections 312 via the converging entrance 313*a* for pivotal retention in the first pivot retainer unit 31 of the base plate 30. The first support lever 51 further has an intermediate portion formed with an aligned pair of cylindrical outward pins 513 which are disposed respectively on two outer edges of the first support lever 51, and a pair of engaging notches 514 that are disposed respectively on the outer edges of the first support lever 51 adjacent to the outward pins 513. Referring to FIG. 4, each of the engaging notches 514 extends from an upper side to a lower side of the first support lever 51 and is confined by opposite angled first and second walls. The angled first wall has a first upper wall section 514*a* and a first lower wall section 514*b*. The angled second wall has a second upper wall section 514*c* parallel to the first lower wall section 514*b*, and a second lower wall section 514*d* parallel to the first upper wall section 514*a*. As shown, the engaging notch 514 has a constricted intermediate section and opposite diverging end sections, each of which opens to a respective one of the upper and lower sides of the first support lever 51 and has a predetermined maximum width.

Referring again to FIG. 3, the second support lever 52 is formed as a generally U-shaped frame which includes parallel rods 526 that flank the outer edges of the first support lever 51, and a transverse rod 521 which interconnects the parallel rods 526 at an upper portion of the second support lever 52. The transverse rod 521 is retained pivotally in the second pivot retainers 61 of the key cap 60. The second support lever 52 is formed with opposite outward slide shafts 522 which project outwardly and respectively from the parallel rods 526 at a lower portion of the second support lever 52. Each of the outward slide shafts 522 tapers in a direction away from a respective one of the parallel rods 526 to form an inclined bottom face 523 that complements the inclined top surface 322 on a respective one of the flange units 32 so as to facilitate insertion of the slide shafts 522 resiliently into the L-shaped slots 323. The outward slide shafts 522 abut against the bottom surfaces of the flange units 32 for slidable retention in the slide recesses 324 (see FIG. 5). The lower portion of the second support lever 52 is further formed with opposite inward slide shafts 527 which project inwardly from inner edges of the parallel rods 526 and which abut slidably against the indented top surface of the first hole defining portion 35.

The second support lever 52 further has an intermediate portion formed with an aligned pair of pin bores 524 disposed respectively on the inner edges of the parallel rods 526. Each of the pin bores 524 is formed with an entrance 524*a* which diverges in a direction away from the pin bore 524. Each of the cylindrical outward pins 513 on the first support lever 51 extends fittingly and rotatably into a respective one of the pin bores 524 via the entrance 524*a* to serve as a pivot axis and to couple rotatably and firmly the intermediate portions of the first and second support levers 51, 52. The intermediate portion of the second support lever 52 is further formed with a pair of generally rectangular engaging tabs 525 which are formed on the inner edges of the parallel rods 526 adjacent to the pin bores 524 and which extend between upper and lower sides of the parallel rods 526. Each of the engaging tabs 525 is received in a respective one of the engaging notches 514 of the first support lever 51, and has a thickness generally equal to the width of the constricted intermediate section of the engaging notch 514.

Figure 7:
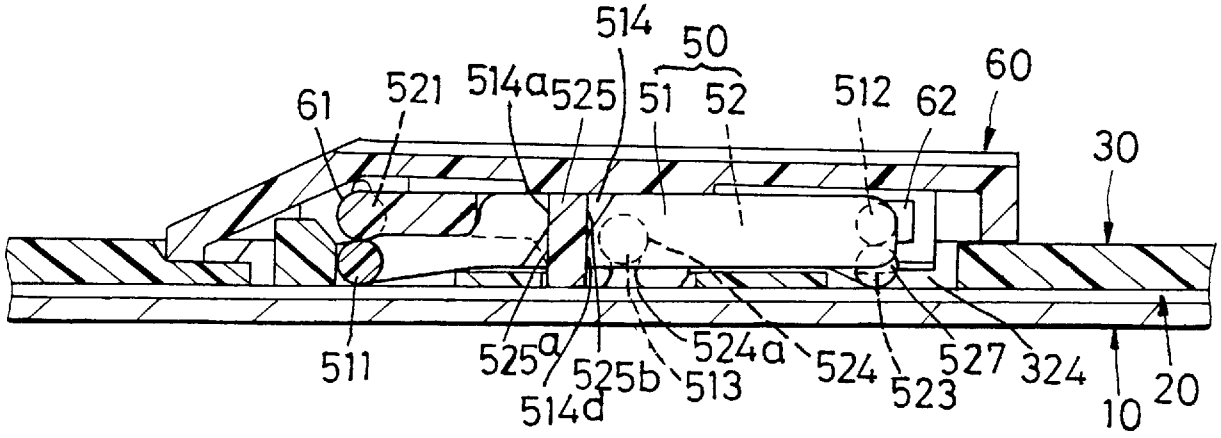
FIG. 7 is a vertical sectional view of the key switch assembly of the preferred embodiment when the key cap is in a fully-depressed state.

Referring to FIGS. 5 and 7, each of the engaging tabs 525 has opposite first and second side surfaces 525*a*, 525*b* which are parallel to each other. The maximum predetermined width of the diverging end sections of the engaging notches 514 is sufficient to limit pivoting movement of the engaging tabs 525 between a first position where the key cap 60 is in a non-depressed state, as shown in FIG. 5, and a second position where the key cap 60 is in a fully-depressed state, as shown in FIG. 7. In the first position, referring to FIG. 5, the first side surfaces 525*a* of the engaging tabs 525 abut against the first lower wall sections 514*b* while the second side surfaces 525*b* of the engaging tabs 525 abut against the second upper wall sections 514*c*. In the second position, referring to FIG. 7, the first side surfaces 525*a* abut against the first upper wall sections 514*a* while the second side surfaces 525*b* abut against the second lower wall sections 514*d*.

In mass production, assembly of the key switch assembly of the present embodiment may be completed in an automated manner with the use of a machine. The pivot shafts 511 of the first support lever 51 are forced resiliently into the first pivot retainers 313 in the base plate 30. Since the slide shafts 522 of the second support lever 52 have inclined bottom surfaces 523 that complement the inclined top faces 322 of the flange units 32, and since the parallel rods 526 impart inward resiliency to the slide shafts 522, the slide shafts 522 can be easily pressed downward for insertion into the L-shaped slots 323 of the base plate 30. Subsequently, the intermediate portion of the second support lever 52 is pushed toward the intermediate portion of the first support lever 51 so as to press-fit the cylindrical outward pins 513 of the first support lever 51 in the pin bores 524 of the second support lever 52 via the entrances 524*a*. In this situation, the engaging tabs 525 of the second support lever 52 are simultaneously received in the engaging notches 514 of the first support lever 51. The key cap 60 is then assembled to the key cap support 50 and the base plate 30 by press-fitting the transverse rod 521 of the second support lever 52 into the second pivot retainers 61 in the key cap 60 and by extending the inward slide projections 512 of the first support lever 51 into the second slot retainers 62.

After assembly, the key cap 60 is normally biased upwardly by the biasing member 40 when the key cap 60 is in a non-depressed state, as shown in FIG. 5. At this time, since the first side surfaces 525*a* of the engaging tabs 525 abut against the first lower wall sections 514*b* of the notches 514 while the second side surfaces 525*b* abut against the second upper wall sections 514*c* of the notches 514, an enhanced positioning effect in the first position can be provided to the first and second support levers 51, 52.

Figure 6:
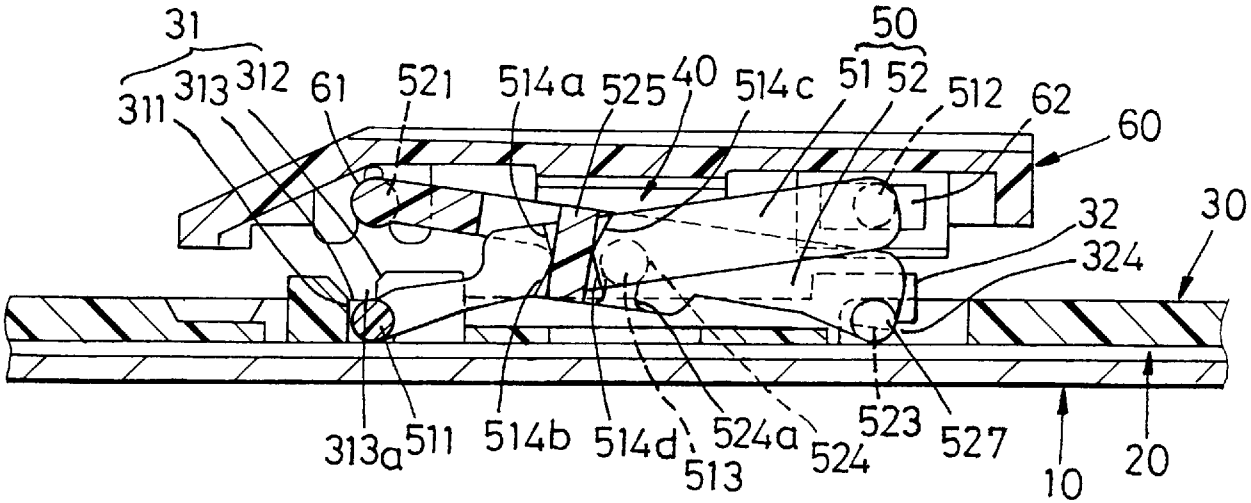
FIG. 6 is a vertical sectional view of the key switch assembly of the preferred embodiment when the key cap is slightly depressed.

Referring to FIG. 6, when the key cap 60 is depressed, the inward slide projections 512 of the first support lever 51 and the outward slide shafts 522 of the second support lever 52 are moved slidably and respectively in the second slot retainers 62 and the L-shaped slots 323, in the longitudinal direction of the base plate 30 and the key cap 60, thereby causing pivoting movement of the first and second support levers 51, 52 relative to each other. In this situation, the engaging tabs 525 are restricted by the constricted intermediate sections of the engaging notches 514. None of the first and second side surfaces 525*a*, 525*b* abut against the wall sections 514*a*, 514*b*, 514*c*, 514*d* at this time.

As shown in FIG. 7, when the key cap 60 is continuously depressed to reach a fully-depressed state, the first side surfaces 525*a* abut against the first upper wall sections 514*a* while the second side surfaces 525*b* abut against the second lower wall sections 514*d*, thereby positioning the engaging tabs 525 in the second position.

Accordingly, the key switch assembly of the present invention permits convenient assembling thereof in an automated manner. In addition, the first and second support levers 51, 52 of the key cap support 50 are more firmly and stably coupled to each other via the coupling between the cylindrical outward pins 513 formed in the first support levers 51 and the pin bores 524 formed in the second support levers 52. Moreover, an enhanced positioning effect can be provided to the key cap support 50 by means of the engagement between the engaging tabs 525 and the engaging notches 514 when the key cap 60 is in a non-depressed state or in a fully-depressed state.

With this invention thus explained, it is apparent that numerous modifications and variations can be made without departing from the scope and spirit of this invention. It is therefore intended that this invention be limited only as indicated in the appended claims.

I claim:

1. A key switch assembly for a computer keyboard, said key switch assembly comprising:

a base board;

a membrane circuit provided on said base board, said membrane circuit having an electrical contact;

an upright biasing member supported on said membrane circuit;

a base plate disposed on said membrane circuit and formed with an opening to permit extension of said biasing member therethrough, said opening having opposite first and second sides, said base plate being further formed with a first slot retainer unit adjacent to said first side of said opening, and a first pivot retainer unit adjacent to said second side of said opening;

a scissors-type key cap support including first and second support levers with upper and lower portions, and intermediate portions that are coupled rotatably about a pivot axis, said lower portion of said first support lever being retained pivotally in said first pivot retainer unit of said base plate, said lower portion of said second support lever being retained slidably in said first slot retainer unit of said base plate; and a key cap having a bottom side formed with a second slot retainer unit for retaining slidably said upper portion of said first support lever, and a second pivot retainer unit for retaining pivotally said upper portion of said second support lever, said key cap being biased upwardly by said biasing member and being capable of being pressed so as to compress said biasing member and enable said membrane circuit to produce an electrical signal;

said first support lever having a generally U-shaped frame section with upper and lower sides and opposite outer edges, said intermediate portion of said first support lever being formed with an aligned pair of cylindrical outward pins disposed respectively on said outer edges of said first support lever;

said second support lever being formed as a generally U-shaped frame which includes parallel rods that flank said outer edges of said first support lever, and a transverse rod that interconnects said parallel rods at said upper portion of said second support lever, each of said parallel rods having upper and lower sides and an inner edge, said intermediate portion of said second support lever being formed with an aligned pair of pin bores disposed respectively on said inner edges of said parallel rods, each of said pin bores being formed with an entrance that opens to said lower side of the respective one of said parallel rods, said outward pins on said first support lever extending fittingly and rotatably into a respective one of said pin bores via said entrance so as to couple rotatably said intermediate portions of said first and second support levers;

said intermediate portion of said second support lever being further formed with an engaging tab which is disposed on said inner edge of one of said parallel rods adjacent to said pin bore and which extends between said upper and lower sides of said one of said parallel rods;

said intermediate portion of said first support lever being further formed with an engaging notch which is disposed on one of said outer edges of said first support lever adjacent to said outward pin and which extends from said upper side to said lower side of said first support lever, said engaging notch receiving said engaging tab therein and having a predetermined width sufficient to limit pivoting movement of said engaging tab therein between a first position, where said key cap is in a non-depressed state, and a second position, where said key cap is in a fully depressed state.

2. The key switch assembly of claim 1, wherein said engaging notch has a constricted intermediate section and opposite diverging end sections which open to a respective one of said upper and lower sides of said first support lever, each of said diverging end sections having a maximum width equal to said predetermined width, said constricted intermediate section having a width equal to thickness of said engaging tab.

3. The key switch assembly of claim 2, wherein said engaging notch is confined by opposite angled first and second walls, said first wall having first upper and first lower wall sections, said second wall having second upper and second lower wall sections, said engaging tab having opposite side faces that abut against said first lower wall section and said second upper wall section when said engaging tab is in the first position, and that abut against said first upper wall section and said second lower wall section when said engaging tab is in the second position.

4. The key switch assembly of claim 3, wherein said opposite side faces of said engaging tab are parallel to each other, said first lower wall section being parallel to said second upper wall section, said first upper wall section being parallel to said second lower wall section.

5. The key switch assembly of claim 1, wherein said entrance of each of said pin bores diverges in a direction away from said pin bore to facilitate fitting of the respective one of said outward pins in said pin bore.

6. The key switch assembly of claim 1, wherein said base plate includes:

a hollow rectangular key confining frame portion;

aligned first and second hole defining portions extending inwardly from said frame portion and having terminating edges that confine said first and second sides of said opening; and opposite flange units extending inwardly from said frame portion toward a respective one of two opposite longitudinal edges of said first hole defining portion so as to form two L-shaped slots within said frame portion at said two opposite longitudinal edges of said first hole defining portion, said L-shaped slots constituting said first slot retainer unit and having said lower portion of said second support lever extending slidably therein, said flange units having bottom surfaces which cooperate with said membrane circuit to form slide recesses therebetween.

7. The key switch assembly of claim 6, wherein said lower portion of said second support lever is formed with opposite outward slide shafts which are inserted into said L-shaped slots and which abut slidably against said bottom surfaces of said flange units for slidable retention in said slide recesses.

8. The key switch assembly of claim 7, wherein each of said flange units has an inclined top surface which inclines downwardly in a direction toward said slot units, each of said outward slide shafts being resilient and tapering in a direction away from a respective one of said parallel rods to form an inclined bottom surface that complements said inclined top surface on a respective one of said flange units so as to facilitate insertion of said outward slide shafts into said L-shaped slots.

9. The key switch assembly of claim 7, wherein said first hole defining portion has a top surface that is indented with respect to a top surface of said frame portion, said lower portion of said second support lever being further formed with opposite inward slide shafts which abut slidably against said top surface of said first hole defining portion.

10. The key switch assembly of claim 7, wherein said second hole defining portion is formed with opposite cantilevers which extend away from a respective one of two opposite longitudinal edges thereof, and opposite barb projections formed on said opposite longitudinal edges of said second hole defining portion and aligned spacedly and respectively with said cantilevers, said cantilevers and said barb projections constituting said first pivot retainer unit.

11. The key switch assembly of claim 10, wherein said lower portion of said first support lever is formed with opposite outward pivot shafts forced between aligned ones of said cantilevers and said barb projections for pivotal retention thereat.

12. The key switch assembly of claim 11, wherein the aligned ones of said cantilevers and said barb projections have top edges that form a converging entrance to facilitate forcing of said outward pivot shafts therebetween.

13. The key switch assembly of claim 11, wherein said cantilevers form clearances with said frame portion to enhance resiliency of said cantilevers.

* * * * *